United States Patent [19]

Simson

[11] Patent Number: 4,620,419

[45] Date of Patent: Nov. 4, 1986

[54] HYDRAULIC CYLINDER WITH POWER-MULTIPLICATION

[75] Inventor: Dionizy Simson, Winterthur, Switzerland

[73] Assignee: ENFO Grundlagenforschungs AG, Döttingen, Switzerland

[21] Appl. No.: 732,723

[22] Filed: May 10, 1985

[30] Foreign Application Priority Data

May 11, 1984 [CH] Switzerland ..... 2357/84

[51] Int. Cl.[4] ..... F15B 7/00

[52] U.S. Cl. ..... 60/560; 60/563; 60/583; 60/593

[58] Field of Search ..... 60/563, 564, 593, 560, 60/583; 92/65; 91/524, 517

[56] References Cited

U.S. PATENT DOCUMENTS 615,912 12/1898 Sackett ..... 92/65
3,186,173 6/1965 Hogg ..... 60/563
3,473,328 10/1969 Mayhew ..... 60/563
4,153,180 5/1979 Fernique ..... 60/560
4,288,987 9/1981 Grullmeier ..... 60/560

FOREIGN PATENT DOCUMENTS 1176066 8/1964 Fed. Rep. of Germany ..... 92/65

*Primary Examiner*—Robert E. Garrett
*Assistant Examiner*—Mark A. Williamson
*Attorney, Agent, or Firm*—Watson, Cole, Grindle & Watson

[57] ABSTRACT

A hydraulic cylinder device for power multiplication includes a cylinder (1) containing a single-stage piston (2) having a piston rod (4) and a two-stage secondary piston (3), the piston rod (4) extending through a bore in the secondary piston. The cylinder (1) is closed by a cylinder cover (16) through which the piston rod (4) also extends. Two stop-pistons (22, 24) with different strength springs (21, 23) are located in projection (20) integral with cylinder (1) and opposite the stop-pistons are two opening-pistons (33, 34).

3 Claims, 1 Drawing Figure

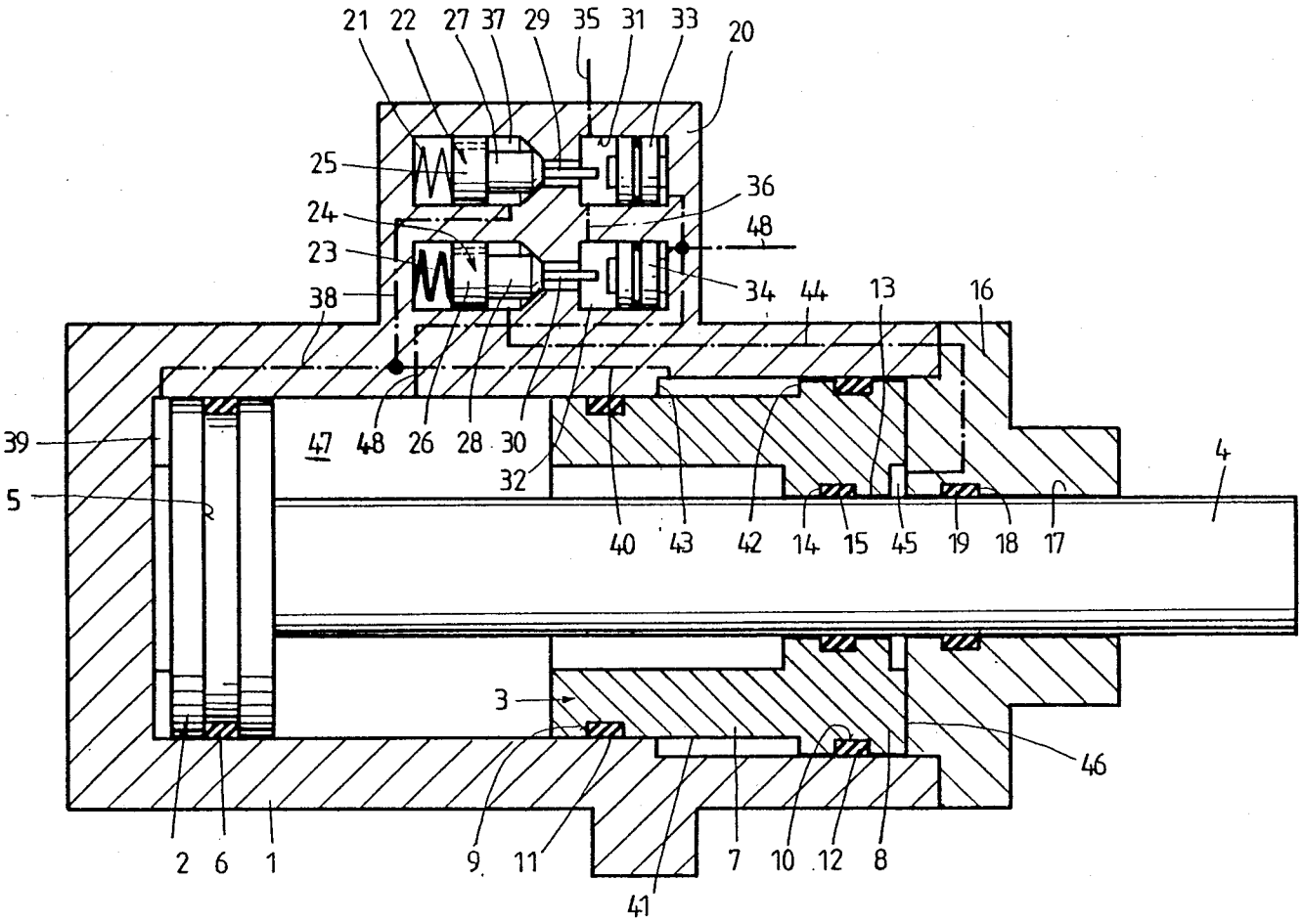
4
17
18
19
45
15
14
42
43
40
32
30
28
26
48
47
38
23
24
25
21
22
27
37
29
35
31
33
20
34
48
36
44
13
16
46
8
12
10
7
41
11
9
3
1
6
2
5
39

HYDRAULIC CYLINDER WITH POWER-MULTIPLICATION

BACKGROUND OF THE INVENTION

1. Field of the Invention

The present invention relates generally to hydraulic devices and, more particularly, to hydraulic cylinder devices capable of internal hydraulic intensification for power multiplication.

2. The Prior Art

In many applications hydraulic cylinders are required which are capable of producing a quick stroke of little power or force and a subsequent short, slow stroke of relatively greater power. In applications such as manufacturing machines and presses as well as ram and tractive type apparatus used for excavation, hydraulic cylinders with hydraulic intensification are used. Such cylinders are more compact and lighter than single-stage hydraulic cylinders of equal work power.

Hydraulic cylinders with hydraulic intensification which contain two successive pistons and three chambers are known see, for example, British Pat. Nos. 1,600,733 and 1,420,389; U.S. Pat. No. 4,011,724 and German Published Application No. 31 19 307 Al. With such a construction for a hydraulic cylinder, a dividing wall is required between the pistons and the pistons move in the same direction during a work cycle, e.g., during a clamping operation. As a consequence, the length of the cylinder must be increased up to twice the thickness of the dividing wall. Furthermore, if the primary piston encounters no resistance during its movement, the intensification cycle will be initiated when the piston contacts the cover of the cylinder. Consequently, the cylinder cover must be designed to have sufficient strength to avoid breakage during intensification, which contributes significantly to the overall size and weight of the hydraulic cylinder.

SUMMARY OF THE INVENTION

It is therefore a feature of the present invention to provide a hydraulic cylinder which does not include a dividing wall between the pistons.

It is another feature of the invention to provide a hydraulic cylinder which is of a reduced size and weight.

Briefly, in its broader aspects, the present invention comprehends a hydraulic cylinder device comprising a cylinder, a single-stage primary piston within the cylinder, the primary piston having a piston rod extending axially in the cylinder, and a two-stage secondary piston within the cylinder, the piston rod of the primary piston extending through a bore in the secondary piston.

Further objects, advantages and features of the present invention will become more fully apparent from a detailed consideration of the arrangement and construction of the constituent parts as set forth in the following description taken together with the accompanying FIGURE.

DESCRIPTION OF THE FIGURE

The FIGURE shows a cross sectional view through a preferred embodiment of a hydraulic cylinder device according to the invention.

DETAILED DESCRIPTION OF THE PREFERRED EMBODIMENT

The preferred embodiment of the inventive hydraulic cylinder device includes a cylinder 1 having two bores of different diameters. The smaller diameter bore contains a single-stage primary piston 2 and the larger diameter bore partially contains a two-stage secondary piston 3. The primary piston includes a piston rod 4 which extends axially within cylinder 1 and through a bore 13 in the secondary piston. Primary piston 2 is constructed with circumferential groove 5 having packing ring 6 therein.

Portion 7 of secondary piston 3 has a diameter approximately equal to the smaller diameter bore of cylinder 1 and portion 8 of the secondary piston has a diameter approximately equal to the larger diameter bore of the cylinder. Portion 7 is provided with an external circumferential groove 9 containing gasket ring 11 and, in a like fashion, portion 8 has a circumferential groove 10 with a washer 12 contained therein. Bore 13 through secondary piston 3 has an internal annular groove 14 containing a packing 15. The open end of cylinder 1 is closed by cover 16 having a bore 17 about piston rod 4, the bore having annular groove 18 containing packing 19.

Integral with cylinder 1 is projection 20 which contains first stop-piston 22 biased by weak spring 21 and second stop-piston 24 biased by strong spring 23. First stop-piston 22 is of two-stage construction with portion 25 of larger diameter and portion 37 of smaller diameter and is constructed with piston rod 29 which extends into chamber 31 containing open-piston 33. In a similar manner, second stop-piston 24 is of two-stage construction with portion 26 of larger diameter and portion 28 of smaller diameter, the piston being connected to piston rod 30 which extends into chamber 32 containing opening-piston 34.

In-take passage 35 in projection 20 for the flow of pressure medium leads into chamber 31 at a point adjacent to the region where piston rod 29 contacts opening-piston 33. Passage 36 interconnects chambers 31 and 32. Chamber 37 about portion 27 of stop-piston 22 is connected by passage 38 with first pressure chamber 29 formed by primary piston 2 and the end of cylinder 1. Branch passage 40 leads from passage 38 to step chamber 41 formed by smaller diameter portion 7 of secondary piston 3, shoulder 42 formed at the transition between portions 7 and 8 of the piston, the larger bore of cylinder 1, and shoulder 43 formed at the transition between the two bores of the cylinder.

Chamber 49 about smaller diameter portion 28 of stop-piston 24 is connected by passage 44 with second pressure chamber 45 formed by end surface 46 of secondary piston 3 and cylinder cover 16. Chamber 47 between primary piston 1 and secondary piston 3 is connected by passage 48 with chambers 50 and 51 adjacent to opening-pistons 33 and 34 respectively.

In operation of the hydraulic cylinder device, as medium under pressure is admitted through in-take passage 35, first stop-piston 22 biased by weaker spring 21 opens and pressure medium flows into first primary chamber 39, thereby moving primary piston 2 towards secondary piston 3. The movement of primary piston 2 continues until the piston encounters a resistance, at which time second stop-piston 24 opens and first stop-piston 22 closes. Pressure medium then flows into second pressure chamber 45 adjacent cover 16, thereby creating pressure against end surface of secondary piston 3, causing it to move towards the primary piston 2. As a result, pressure medium contained in step chamber 41 is caused to flow via passages 40 and 38 into first pressure chamber 39 adjacent to primary piston 2. Thus, primary piston 2 is caused to move at reduced speed and higher power corresponding to the surface relationship between surface 43 and surface 42 (surface 43/surface 42).

During the above-described movements of primary piston 2 and secondary piston 3, pressure medium passes from unpressurized chamber 47 through passage 48 into a suitable receptacle (not shown). When the desired work has been accomplished by piston rod 4 such as, for example, a clamping operation, the flow of pressure medium into intake passage 35 ceases, second stop-piston 24 closes and both stop-pistons 22 and 24 act as safety valves.

To reverse the operation of the hydraulic cylinder device, pressure medium is admitted to passage 48 and acts on both opening-pistons 33 and 34 to thereby open stop-pistons 22 and 24. As a result, primary piston 2 and secondary piston 3 are caused to move away from each other by the pressure medium flowing into chamber 47 and to reach the positions as shown in the drawing. Pressure medium contained in unpressurized chambers 39, 41 and 45 flows through opened stop-pistons 22 and 24 and out in-take passage 35 into a suitable receptacle (not shown).

An advantage of the subject hydraulic device is that, in the event primary piston 2 encounters no resistance as it travels toward secondary piston 3, the primary piston will cover or block the opening of passage 48 into chamber 47. Thus, secondary piston 3 cannot move since the discharge is blocked. In addition, if the quick stroke is protracted and the charge-over cycle begins shortly before passage 48 is opened, primary piston 2 and secondary piston 3 will touch each other. In both situations, no cylinder damage results and large forces do not have to be interrupted.

While there has been shown and described what is considered to be a preferred embodiment of the present invention, it will be obvious to those skilled in the art that various changes and modifications may be made therein without departing from the invention as defined in the appended claims.

It is claimed:

1. A hydraulic cylinder device which comprises a cylinder which includes a first end and a second end and which defines a central axis therethrough, said second end having a bore therethrough along said central axis, said cylinder also including an internal bore which extends along said central axis, said internal bore including a first portion of smaller diameter and a second portion of a larger diameter, said second portion being separated from said first portion by a first annular step which faces said second end of said cylinder;

a primary piston which is sealingly postioned in said first portion of said internal bore and is movable along said central axis, said primary piston including a piston rod which extends along said central axis and sealingly and movably extends through the bore in said second end of said cylinder, said primary piston and said first end of said cylinder defining a first pressure chamber therebetween;

a secondary piston which is positioned in said bore and is movable along said central axis, said secondary piston having a bore therethrough through which said piston rod sealingly and movably extends, said secondary piston also including a first part of smaller diameter which is sealingly positioned in said first portion of said bore and a second part of larger diameter which is sealingly positioned in said second portion of said bore, said second part being separated from said first part by a second annular step which faces said first end of said cylinder, said second annular step and said first annular step helping define a step chamber therebetween, said second part of said secondary piston and said second end of said cylinder defining a second pressure chamber therebetween;

hydraulic control means;

a first fluid conduit means connecting said first pressure chamber with said step chamber;

a second fluid conduit means connecting said hydraulic control device with said first fluid conduit means; and a third fluid conduit means connecting said hydraulic control device with said second pressure chamber.

2. The hydraulic cylinder device as defined in claim 1, wherein said hydraulic control device comprises first and second stop valves, a fourth fluid conduit means connected to said first stop valve for fluid input and a fifth fluid conduit means connected between said first and second stop valves, and wherein said second fluid conduit means is connected to said first stop valve and said third fluid conduit means is connected to said second stop valve.

3. The hydraulic cylinder device as defined in claim 2, wherein said primary piston and said secondary piston define a third pressure chamber therebetween, and wherein said hydraulic cylinder device includes a sixth fluid conduit means connected between said third pressure chamber and both of said first and second stop valves.

* * * * *